United States Patent [19]

Stellwagen

[11] 3,933,138

[45] Jan. 20, 1976

[54] SPARK DISTRIBUTOR

[75] Inventor: Jean Henri Stellwagen, Paris, France

[73] Assignee: Societe Anonyme pour l'Equipement Electrique des Vehicules S.E.V. Marchal, Issy-les-Moulineaux, France

[22] Filed: Dec. 20, 1973

[21] Appl. No.: 426,898

[30] Foreign Application Priority Data

Dec. 27, 1972 France ..... 72.46487

[52] U.S. Cl. ..... 123/146.5 R; 200/31 A

[51] Int. Cl.[2] ..... F02P 1/00

[58] Field of Search ..... 123/146.5 R; 200/19 M, 200/31 A, 31 P, 31 V

[56] References Cited

UNITED STATES PATENTS

| | | | |
|---|---|---|---|
| 3,242,274 | 3/1966 | Sanden | 200/31 A |
| 3,301,973 | 1/1967 | Bevaequa | 200/31 V |
| 3,613,652 | 10/1971 | Stellwagen | 123/146.5 |
| 3,799,135 | 3/1974 | House | 123/146.5 |

*Primary Examiner*—Wendell E. Burns
*Assistant Examiner*—James W. Cransin
*Attorney, Agent, or Firm*—N. Jerome Rudy

[57] ABSTRACT

Spark distribution method and means of the variable magnetic flux type for internal combustion engines comprising respective cooperative steps and parts in and for a spark distributor including: a spark shaft inside a housing with a gear on the shaft that is driven thereby and rotatably movable with the shaft by means of at least one integral advance wheel or element that may be of a centrifugal design and which is displaced towards a magnetic flux "captor" element which channels magnet flux towards the shaft, there being in the wall of the housing opposite the advance device a slot roughly perpendicular to the shaft and a corresponding orifice in said advance device which is opposite the slot so that the optimum static adjustment of the spark point being conducted may be accomplished by first positioning the gear with respect to the captor and then setting the distributor from without the housing to a calibrated mark on the external surface of the housing with matched placement therewith of the head of a setting device which passes through the slot to be fixed at its inner end in said orifice and which has a fragile break area disposed inside the housing allowing its outwardly extending portion to be broken off after the distributor setting is made and the shaft rotated. The distributor means is particularly useful as a component of an automobile engine.

17 Claims, 6 Drawing Figures

SPARK DISTRIBUTOR

BACKGROUND OF THE INVENTION

The present invention lies in the field of novel, readily adjustable spark distributors and the like for internal combustion engines.

It is known that during the functioning of a spark distributor for an internal combustion or the like engine an attempt is made to establish a precise adjustment of the spark point. In fact, such an improvement and fine control in the adjustment of the spark assures the best combustion of the gases in any internal combustion engine, especially those utilized for an automobile's or the like vehicles with which the spark distributor is associated in the engine.

Known distributors in current use generally include at least a mechanical breaker arranged in the primary wiring in the coil. Such systems have inherent disadvantages, all of which are well known in and to those skilled in the art. The inconveniences presented by the mentioned conventional type of distributor are of several types. First, they usually necessitate the presence of several mechanical linkages and apparatus which cooperate with one another for the purpose of bringing out the desired movement of each breaker. Secondly the repetition of the arcs of the spark causes wear on the plated screws ordinarily present in the assembly. Third, the use of purely mechanical apparatus unavoidably brings about certain limitations which are generally observable and manifest in the rate of start up of the mechanisms; all of this occurring so that, and in a parallel manner, a plateau or "dead end", as it were, is reached whenever the motor is required to accelerate which, of course, is the time when greatest and most instantaneous spark action and performance is desired and required.

Amongst the objectives of the present invention is to overcome the difficulties and deficiencies of prior art in the spark distributor field for internal combustion engines and the like, as is entirely evident in and from the following Specification.

In order to compensate for these various forces and causes of possible maladjustment of the spark points (generally due to wear and tear) and in order to obtain a shorter reaction time corresponding to the normal operation of the motor in certain cases, according to a recent technique, the mechanical spark breaker is replaced with a sparking device which has a magnetic flux variation. This latter embodiment makes it possible on the one hand, to eliminate all of the causes of maladjustment of a mechanical origin and, on the other, to assure faster speed up or acceleration of the engine.

The utilization of the presently contemplated flux variation technique for realization of a spark in internal combustion engines has been generally known for a number of years past. In substantiation of this, reference may be had to U.S. Pat. Nos. 3,145,224; 3,316,446; and 3,357,416.

The optimim static adjustment of the spark point of a distributor (which includes a mechanical breaker) is easily obtained. For example, it can be achieved by turning the shaft of the distributor until obtaining the opening of the breaker (such opening being possible to check in several ways including under lamp light, such as by so-called strobe lamps). The same operating technique makes it possible to obtain a later rapid adjustment of the distributor whenever the same may be required for any reason, as may be in the case when the distributor has been taken apart and must be again adjusted in order to function within the best conditions mentioned above.

The technique of adjusting the spark point of a distributor utilizing and having magnetic flux variation is more complex. It ordinarily necessitates, for example, the marking of the tooth of a gear, then the bringing of this tooth in front of a magnet flux "captor" made of an element which channels this magnetic flux towards the shaft, the said element or organ being connected to a permanent magnet and constituting the nucleus of the induction coil. For example, the adjustment of such a distributor may be obtained by using an external flux and by marking on a test bench the relative position of one tooth of the wheel and of the "captor" leading to the perfect adjustment of the spark point of the distributor. The certainty of maintaining of this relative position of the gear wheel and of the captor is a delicate thing both at the time of finishing the assembling of the distributor and whenever one proceeds with re-installing it, following for example the repair or change of at least one of any of its component parts.

The primary purpose of the present invention is to provide a simple means for adjusting the points of a distributor, this adjustment being capable of being conducted from the outside of the distributor housing by means of a blockage element or organ or of an easy-to-use key of an uncomplicated nature. The adjustment can be accomplished without any intermediate transformation before the final assembling of the distributor points under consideration so that it can be done at the time of re-assembling it whenever it has been necessary to repair it.

The present invention thus has as its basic object a process for the temporary setting (in a pre-adjusted position) and later rapid adjustment of an ignition distributor which has a variable magnetic flux, designed in particular to cooperate with an internal combustion engine for automobiles. This distributor includes on the inside of a housing, a spark shaft on which is arranged a gear moved along by the said shaft and movable by rotation with respect to the shaft based upon the effect of at least one centrifugal advance device or wheel. The said gear is displaced in front of a magnetic flux captor made of a device which channels this magnetic flux towards the shaft, this said device being connected with a permanent magnet and constituting the nucleus of an induction coil. Practice of the present invention may be characterized in that the setting is carried out, on the one hand, in the wall of the housing opposite an element of the centrifugal advance device solidly connected to the shaft through a slot whose average line is located roughly on a perpendicular plane to the axle of the distributor shaft and, on the other hand, in the zone of the element of the centrifugal advance device rigidly connected to the shaft located opposite the said slot, an orifice and by the fact that the optimim static adjustment is conducted for the spark points by positioning the gear with respect to the captor and also by the further fact that assembly may be made of the distributor while simultaneously maintaining part of a positioning and setting bar opposite the said mark.

The present invention also has as a further object the provision of and as a new industrial product which constitutes a device for the temporary setting in a pre-adjusted position and the rapid later adjustment of a spark distributor which has a variable magnetic flux, designed in particular to cooperate with an internal combustion motor for an automobile vehicle, this distributor including on the inside of the housing a spark shaft on which is arranged a gear which is moved by the said shaft and capable of being rotated with respect to this shaft under the effect of at least one centrifugal advance device or gear, the said wheel being displaced in front of a magnetic flux captor element made of a device which channels the magnetic flux towards the shaft, the said captor element being connected to a permanent magnet and constituting the nucleus of the induction coil; all of which is characterized by the fact that the wall of the housing has, with regard to the centrifugal advance device which is one piece with the shaft, a slot whose average line is situated roughly on a plane perpendicular to the axis of the distributor shaft, and also by the fact that the said element of the centrifugal advance device (which is one piece with the shaft) has an orifice which cooperates with the bar of a setting device whose head is held against the external surface of the wall of the distributor housing and which passes through the slot in the said wall and has a fragile break zone arranged on the inside of the said housing.

PARTICULAR DESCRIPTION AND CHARACTERIZATION OF THE INVENTION

In a preferred mode of embodiment or realization in practice of the present invention, the setting device which cooperates with the element of the centrifugal advance device which is one piece with the shaft, is advantageously made of a synthetic material, for example, nylon. The setting device is of the screw, bolt, or peg type. It has a threaded rod and the opening made in the centrifugal advance device is a threaded hole whose threads cooperate with the threads of the bar of the setting device. The setting device cooperates with the lower plate of the centrifugal advance device which is generally best embodied as a one piece unit with the spark distributor shaft.

Since the opening cooperates with the bar of the adjustment device, the axle is roughly radial and the slot made by the bar of the said setting device is accomplished roughly transversely in the lateral wall of the distributor housing. The orifice which cooperates with the bar of the setting device is perforated in a flange which is one piece with the lower level of the centrifugal advance device which is accordingly one piece with the distributor shaft. The flange is thus roughly orthogonal to the plane formed by the said plate and parallel to the lateral wall of the housing.

It can thus be readily observed that the maintaining of the relative position of the gear and the magnetic flux captor corresponding to the optimim adjusting point of the ignition is obtained from the outside of the distributor housing by introducing the bar of the setting device into the slot made in the wall of the housing, then into the opening made in the centrifugal advance device element which is necessarily one piece with the distributor. Upon connection of the bar of the adjustment device and the centrifugal advance device (which is one piece with the shaft) and tightening of the head of the said adjustment device on the external surface of the distributor housing wall, the desired adjustment is simply, quickly and most expeditiously made.

Since the distributor is generally adjusted in one of the first phases of its assembly, it is possible to subsequently finish and set same after assembly without modifying the relative position of the gear and of the flux captor or, in consequence, altering the optimim adjustment of the ignition point.

Advantageously, the position of the bar of the setting device fixed on the housing is marked on the outside of the wall of the housing prior to any starting of the motor or engine involved.

At the time of engine starting, the bar of the setting device (as is apparent in the present description) breaks into two pieces. One of these is removed outside of the housing. The other is held on the device for the centrifugal advance which is moved as the distributor shaft rotates. In this way, at the time of a possible disassembling of the distributor it is thus made possible to then during its reassembly merely turn the distributor shaft until it encounters the fragment of the bar fixed on the centrifugal advance device with respect to the marking point mentioned above, so that the motor will be sure of having the gear replaced into its best position relative to the magnetic flux captor.

It is then readily possible and sufficient to finish the reassembly of the distributor while at the same time maintaining the bar in front of the said marking point so that the distributor will function almost, if not completely, perfectly.

It is thus quite evident that during the course of the reassembly, the angular precision which can be assured is less than a degree. This precision is more than sufficient in the usual case for the automobile to be able to re-start and generally, in that, function with a satisfactory ignition. Naturally, for a mechanical adjustment which necessitates an angular precision in the distributor setting of less than one degree it may be more expedient to partially disassemble the distributor and readjust it after the above-described preliminary adjustment so as to obtain the optimum ignition point.

Still other objects, features and significant advantages of the invention, particularly illustrating its significant and salient possibilities, are most apparent in the following of this Specification and description considered in connection with the accompanying Drawing, in which there is shown a particular individual embodiment of the invention; it being understood that appliances and devices in full accordance with the present invention can be varied and have alternative features and, as indicated, may differ in the actual construction utilized. The invention is thus obviously not limited to the particular arrangement depicted in the accompanying Drawing; it still being understood further that no limitations thereon are intended therefrom.

With particular reference to the particular appliance embodiment illustrated in the Drawing.

Figure 1:
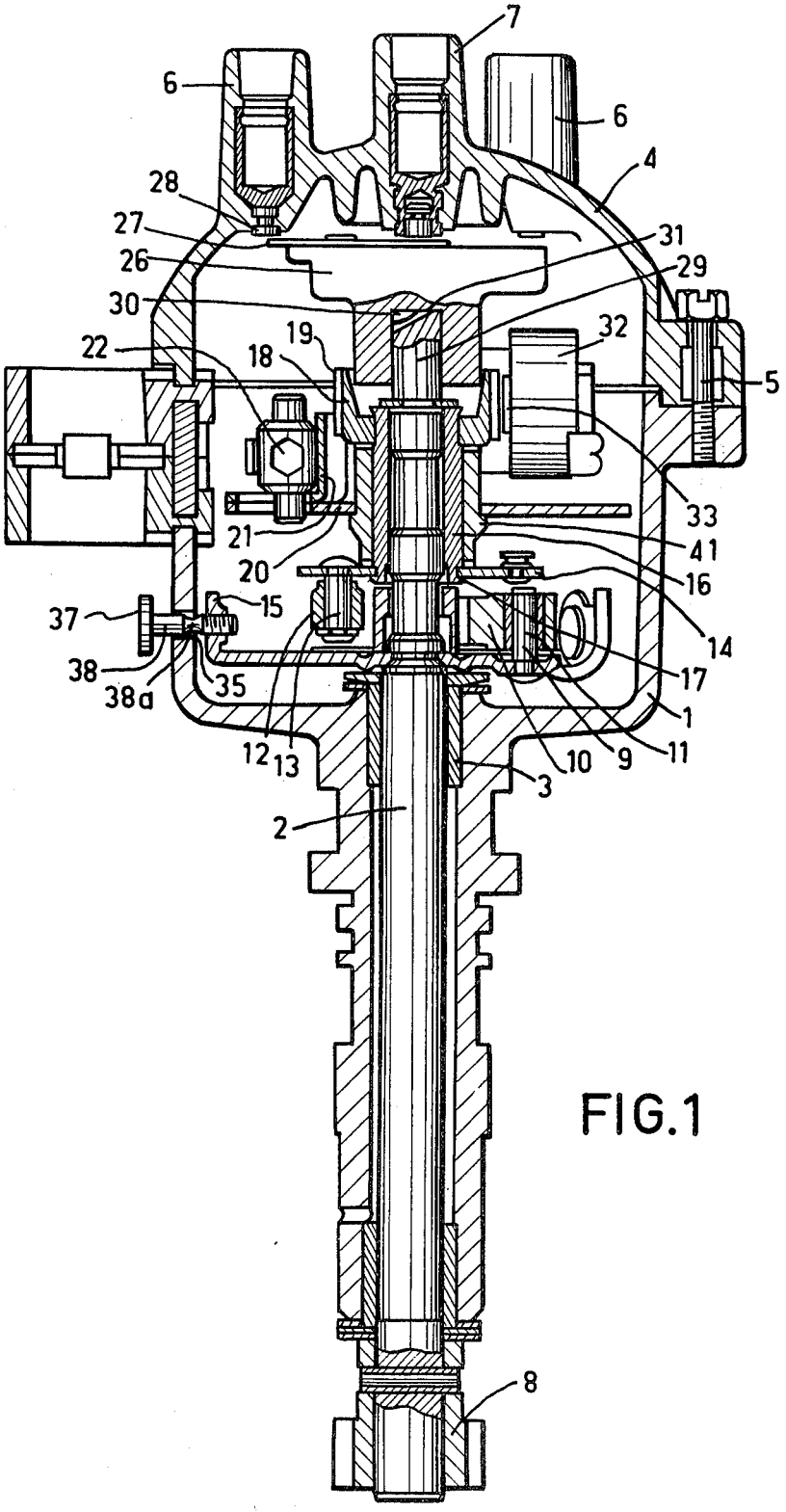
FIG. 1 is a cross-sectional view, taken longitudinally, of a classic ignition distributor equipped with a provisional setting device in a pre-adjusted position and for later quick adjustment according to the invention.
Figure 2:
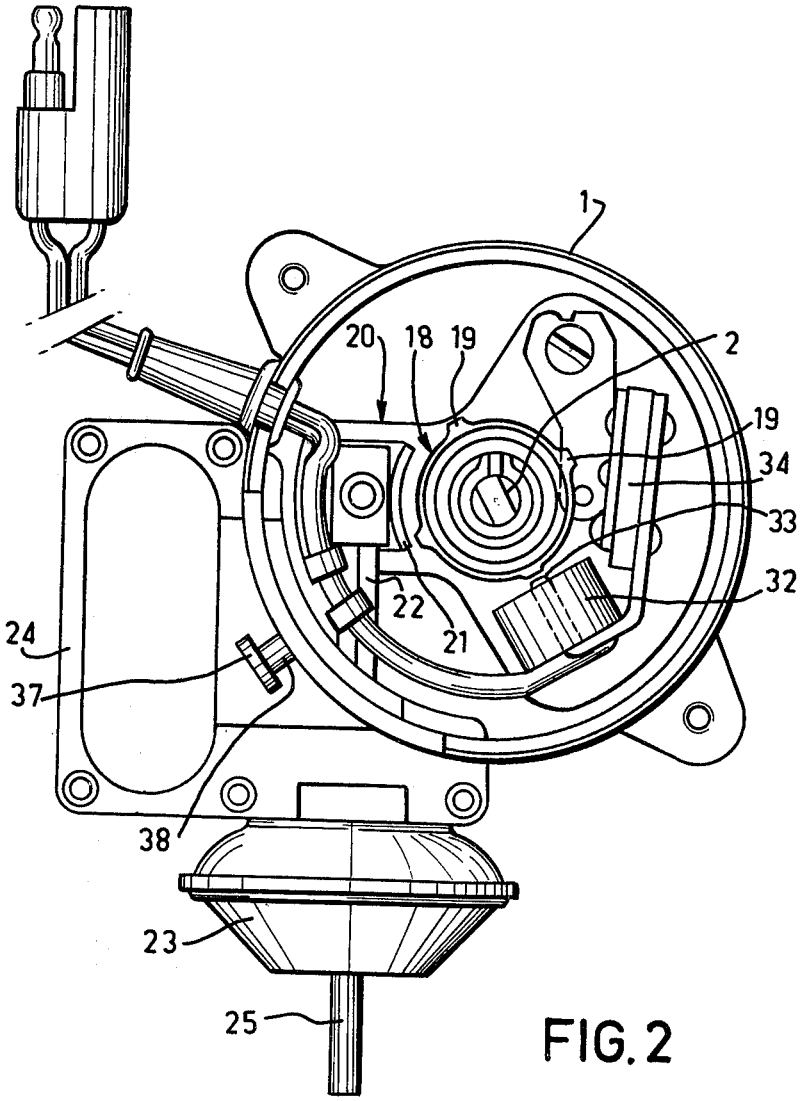
FIG. 2 is a top view of the distributor of FIG. 1, in which the cap placed on the upper part of the housing has been removed.
Figure 3:
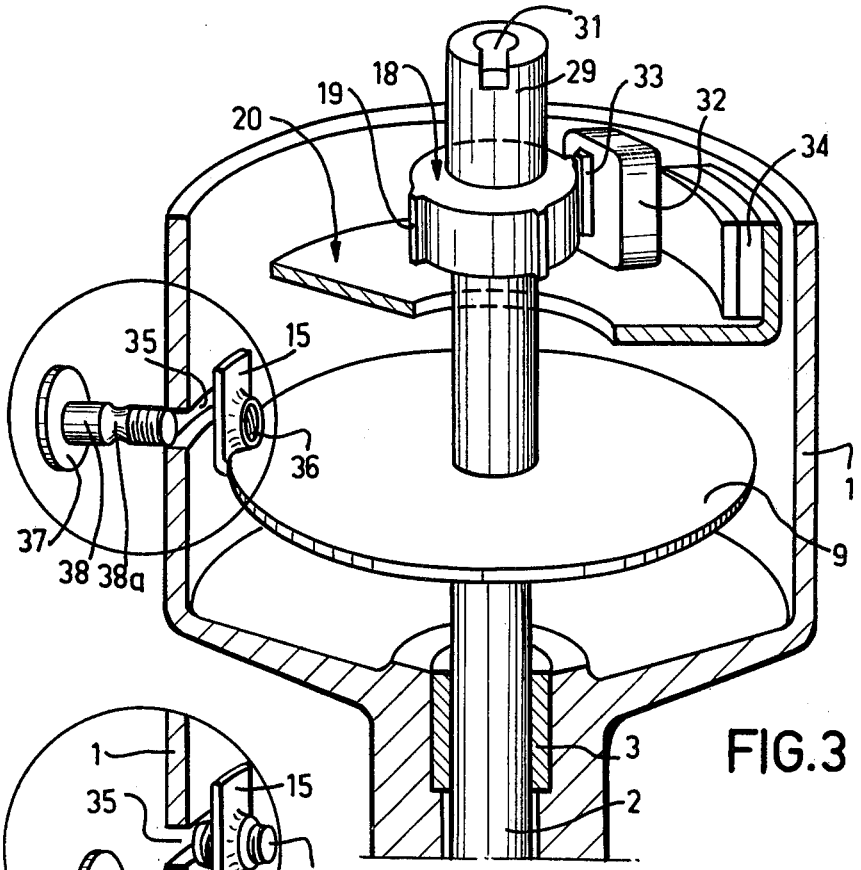
FIG. 3 is a perspective view, partial and simplified, of the distributor of FIG. 1, in which the housing has been cut away longitudinally according to the axis of the distributor shaft, the provisional setting device of the invention being represented in the non-mounted (position) on the housing.
Figure 3A:
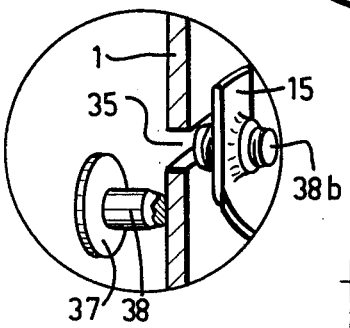
Figure 4:
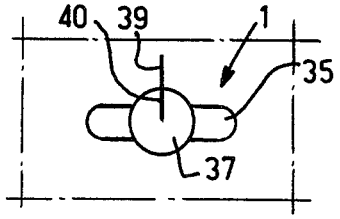
Figure 5:
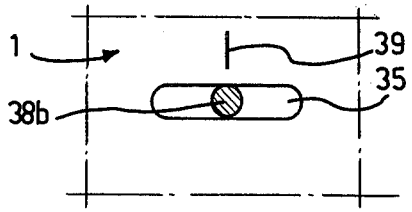

FIG. 3*a* is a detailed view of the setting device of the surface immediately following the rotation control of the distributor shaft;

FIG. 4 is a detailed view depicting the method of marking on the external wall of the distributor housing of the optimim position of the setting device corresponding to the optimim adjustment of the ignition point; and FIG. 5 is a detailed view showing the later rapid adjustment of the distributor from the marking point defined in FIG. 4.

By referring to the several FIGURES of the Drawing it will be seen that reference numeral 1 designates all of the spark distributor housing according to the invention. Reference numeral 2 designates the distributor shaft which turns according to the access of shaft 1, the said housing being maintained in the housing by a bearing 3 placed on the lower part of the housing. A cover 4, set over the housing 1 and fixed thereon by means of bolts 5, has high distribution current posts 6 delivered by the distributor to the spark plugs of the internal combustion engine motor with which the distributor is associated. Cover 4, moreover, has a post 7 connected to the high tension feed coil. The distribution points in this are peripheral and the feed post 7 is central.

The shaft of the distributor is located on its lower part by element or sprocket organ 8 connected to the motor. The spark distributor has, on its lower part, a centrifugal advance device made up of a lower plate 9 which is one piece with shaft 2; on which plate there are symmetrically arranged two feed cables 10 opposite the central shaft 2, each articulated so as to be revolvable around axle 11 carried by lower plate 9. This plate is perpendicular to shaft 2, and the two axles 11 which carry it are parallel to the said shaft. During the course of the rotation of shaft 2, the two feed cables 10 are subjected to a centrifugal force. This causes them to spread from the shaft so as to initiate movement of two rollers 12 each turning around the contact piece 13 fixed to the upper plate 14 of the centrifugal advance device under the effect of the feed cables 10 which tend to extend from shaft 2; the contacts 12 themselves being supported during this time on their outside surface on the profile of the said bearings conveyed along by means of the same movement the upper plate 14 parallel to the lower plate 9. In this sequence, this upper plate is shifted in an angular position with respect to the lower plate.

Feed heads 10 are maintained towards the longitudinal axis of the shaft 2 by means of springs which (not shown) supported by the lower plate which is itself connected to the upper plate by means of a standard spring (which is also not shown). Generally, this latter-mentioned spring is hooked by means of one of its ends to the contact piece 13 of the upper plate and to the other end by a piece 15 which is one with the lower plate situate perpendicular thereto and roughly parallel to the side wall of housing 1.

In the central recess of upper plate 14 which rotates with respect to the distributor shaft, there can be inserted a cylindrical bushing 16, centered on shaft 2, which is set on its lower part by means of a holding device 17 on the lower plate of the centrifugal advance device so as consequently to be movable in a rotating manner around shaft 2. A gear 18 is centered on and fixed to the upper part of this cylindrical bushing 16. For greater precision, gear 18 is made of fritted or powder iron or equivalent. The gear 18 generally has four identical teeth 19 arranged at about a 90° angle to one another, the distributor represented being supposedly associated with a 4-cylinder, 4-cycle motor. Of course, appropriate changes, as will be apparent to those skilled in the art, are and can be made when other type engines are involved.

In any event, the gear 18 which is in one piece connection with the upper movable plate of the centrifugal advance device, is for the above-mentioned reason, rotated by shaft 2. It may have a rotating movement of only limited amplitude with respect to this shaft due to the face that the angular displacement between the lower plate and the upper plate of the centrifugal device. This angular displacement corresponds to the advance or retarding of the spark conferred by the centrifugal device mentioned above.

An advance depression plate 20 which is perpendicular to shaft 2 is centered and set on a cylindrical sleeve 41. A collar is thus formed around the bushing zone 16 so constituted between the upper plate 14 and the gear 18. A curved piece 21, welded by means of its horizontal part to the depression advance plate 20, carries on its vertical portion the bearing for a control bar. The control bar advances the depression 22 directly activated by depression displacement pump 23 which is supported by a horizontal base 24 attached to the housing 1.

In a known manner, the depression advance device completes the correction of the advance established by the centrifugal device. There is thus and accordingly an automatic correction of the advance of the spark as a function of the rotation speed of the motor. For this purpose, pump 23 has a membrane which is subjected to the depression dominating within the inlet collector of the motor and connected to it by means of a tube system 25.

Reference numeral 26 designates the distribution rotor of the spark distributor according to the invention. This rotor is preferably made of a molded plastic piece which is electrically insulated and on its upper part. The rotor carries a conductive tip 27 which is inserted during the molding into this plastic part.

In a known manner, this conductive tip makes it possible to conduct high tension current fed by the central post 7 of cover 4 in the direction of contact pieces 28 of the peripheral post 6; the disrupture being carried out parallel to the axis of the distributor between the tip 27 and the conductor pieces 28 each corresponding to the posts 6 of the said cover. The distributor 26 has at its center a hole drilled on the inside of which the extremity 29 of the central shaft is introduced. Rotor 26 rests on extremity 29 of the shaft and its drive by the shaft is assured by means of a drive pin 20 which penetrates into a notch made in the upper part of the extremity 29 of shaft 2. Naturally, the drive pin 30 is preferably made at the time of the molding of rotor 26.

The variable ignition distributor with magnetic flux finally has, on its top part of the shaft and more precisely with respect to the gear 18, a magnetic flux captor attached to said housing. To better illustrate this, the magnetic flux captor includes an induction coil 32 whose nucleus 33 is connected to a permanent magnet 34 conducting the flux to the shaft 2 by means of the advance depression plate 20. The plane of transversal symmetry of gear 18 is merged with the transversal plane of symmetry of the nucleus 33 so that the teeth of the said wheel 18 are placed exactly opposite nucleus 33 at the time of rotation of the wheel moved by shaft 2.

At the time of assembling of the distributor according to the invention, tooth 19 on which the adjustment is made is marked as is the opposite position 33; the maximum magnetic flux corresponding of course to the position of tooth 19 which is exactly opposite nucleus 33. Due to the difficulties that one may find after assembling the distributor, it is particularly advantageous to keep the positioning of the gear with respect to the captor. This positioning generally corresponds to the optimim static adjustment of the spark points. Since shaft 2 is driven by the motor to which the distributor of the invention is associated, it is clear that the unit of organs or elements centered on the shaft is temporarily one in rotation with shaft 2. The position desired for tooth 19 opposite the nucleus of coil 32 is thus capable of being marked in a definite way on any other element of the distributor which is centered on shaft 2. This particularly applies to the elements adjusted in rotation on the said shaft, namely the lower plate 9 of the advance centrifugal device.

On the wall of the housing there is provided a slot 35 whose average line is situated roughly along a level perpendicular to the axis of the distributor shaft. The slot 35 can be made into the lower wall roughly horizontal to the housing or preferably in the lateral vertical wall of the housing as is represented in the attached FIGURES. At the same time, an opening 36 is made in the area of the lower plate 9 situated opposite slot 35. In this particular case where the slot is made roughly transversally in the lateral wall of the distributor housing, orifice 36 is an access roughly radial and which is perforated for example in a vertical piece 15 which is one with the lower plate 9. Finally, the shaft 2 is set into position with respect to the wall of the distributor by fixing (from the outside of the said housing and on the external surface of wall one of this latter) the head 37 of a setting device whose bar 38 passes through slot 35. The setting device has a fragile break area 38*a* arranged on the inside of the housing and cooperates with the above-mentioned orifice 36. The setting element is generally, for example, a screw, bolt or peg and has a type of bar whose threaded extremity cooperates with an internal threading produced along the lateral wall of orifice 36. The setting element is advantageously made of synthetic material, for example nylon or the like or equivalent. Whenever, by means of the setting device 37–38, the shaft 2 is set in rotation in the position corresponding to the optimim static adjustment of the spark points (as are defined by the relative position of the gear and of the flux captor) the assembly of the distributor can be finished and the pre-set distributor then utilized as may be desired (i.e. put into immediate service or stored for later use).

The distributor of the present invention is associated primarily with an automobile vehicle motor. Thus, in order to employ such a distributor, one proceeds with the starting of the motor while simultaneously keeping head 37 of the setting device in the distributor held against the side wall of the housing. In this way, bar 38 of the said device breaks at the level of its fragile portion, as is designated by reference numeral 38*a*, so that, on the one hand, a fragment 38*b* of the bar remains on the inside of the opening 36 made into the part 15 and, on the other hand, the head 37 of the holding device as well as the initially associated portion or fragment of the bar (which is the part or fragment located ahead of the fragile 38*a*) falls out of housing 1. Shaft 2 of the spark distributor is then freed so that fragment 38*b* of the bar can remain as one with part 15 of the lower plate 9 (which can also move since it is one with the central shaft 2).

ADDITIONAL FEATURES AND CHARACTERISTICS OF THE INVENTION

For the purpose of the proceeding with subsequent quick adjustment(s) of the spark distributor of the invention, one should and will take care before and during the starting of the motor associated with the distributor to mark on point 39 on the external surface of the wall of the housing the position of the setting device whenever it is held onto the housing. This is appropriate, since this position corresponds to the optimim adjustment of the spark point.

The marking of the setting device is obtained either by the marking of the position of bar 38 or, more easily and readily, by the marking of the position of head 37 on which a radial groove 40 can initially be made. After suitable rotation of shaft 2, the head 37 and the upper part of bar 38 drop out and have become clear of the housing. The only remaining mark is then represented by the vertical groove 39 made on the external surface of the vertical wall of housing 1.

Whenever after disassembly of the distributor for repairs of replacement, it is desired to proceed with a quick adjustment of the said distributor, an adjustment (ordinarily and dependably sufficient for the motor to be able to satisfactorily re-start and operate), one turns shaft 2 until bringing fragment 38*b* of setting bar to piece 15 opposite the initial mark 39 made on the wall of the housing.

This relative position of the fragment 38*b* of the bar and the mark 30 correspond to the preferential relative position of the gear and the magnetic flux captor. It is then only necessary and adequate for the purpose to maintain fragment 38*b* opposite mark 39 in order to continue with the re-assembling of the distributor and to assure with regard to the completely re-assembled distributor an ignition spark adjusted in an almost if not completely, perfect manner.

Use of this technique permits the angular positioning of the gear and of the magnetic flux captor to be assured with a value which is ordinarily less than 1°, which value is generally more than sufficient for the creation and definition of a very good and most satisfactory spark. of course, an exceedingly high precision adjustment can be made with additional pre-adjustment (generally best done on the bench) according to the above-mentioned technique and procedure.

Many obvious changes of and modifications in the various features and elements involved in and for practice of the present invention can be readily entered into and realized. Therefore, it is to be fully understood that the invention is not to be limited to or restricted by the several illustrative embodiments and particulars that constitute part of the foregoing description and specification. Rather, knowing the stated intention hereof, the invention is to be interpreted and liberally construed in the light of what is recited and set forth according to the definition and meaning of the hereto appended claims.

What is claimed is:

1. Method for obtaining optimum static adjustment in the spark point of a variable magnetic flux spark distributor for an internal combustion engine and the like, which distributor is comprised of:

a. a housing 1;

b. a spark shaft 2 inside said housing 1;

c. a gear 18 on and driven by said shaft 2 and rotatably movable with respect to said shaft 2; under the effect of d. at least one advancing wheel device element 9 displaced in said distributor housing 1; all in relationship with e. a magnetic flux captor element 33 which channels magnetic flux towards said shaft 2;

f. said captor element 33 being in connected correspondence with the nucleus center of an induction coil 32; all wherein there is g. a slot 35 in the wall of said housing 1 generally disposed within the zone of said advancing wheel element 9, and also disposed so as to be substantially perpendicular to the axle of said shaft 2; wherein h. said advancing wheel element 9 has an orifice 36 in the area located opposite said slot 35;

which method comprises:

A. Providing for association with said advancing wheel element 9 a bar-like setting device 38 of sufficient length to extend from the orifice of said wheel element 9 through said slot 35 without said housing 1, said setting device 38 having a frangible head portion 37 and an intermediate fragile and breakable sector 38*a* disposed inwardly from its head 37;

B. Passing said setting device 38 through said slot 35 in the housing 1 to engage it in said orifice 36 with said fragile and breakable sector 38*a* disposed within said housing 1; while C. Simultaneously holding from without said housing 1 the extending head extremity 37 of said bar-like setting device 38;

D. Positioning in an optimum co-relative spacing relationship said gear 18 and said captor element 33; upon which E. Said distributor is thereby readied for use and/or storage for subsequent use.

2. The method of claim 1, further characterized in that the positioning adjustment of the bar of said setting device is accomplished by matching same to a fixed positioning mark provided on the external face of the wall of said housing of the spark distributor.

3. The method of claim 1, further characterized in that the releasing of the spark distributor shaft is commenced with the starting of the motor associated with the distributor while simultaneously maintaining the head of said setting device held against the housing so that the bar of the said setting device is broken at its fragile zone leaving a fragment of the bar within the housing in said opening in said spark advance element with the outwardly extending head portion of the setting device falling outside of the spark distributor housing permitting free rotation of said shaft.

4. The method of claim 2, being still further characterized in that, after the distributor has been assembled with a rapid adjustment thereof, turning the said shaft bar setting device connected with the advance element which is positioned opposite the mark on the wall of the housing so that the distributor is assembled simultaneous with maintainence of the extending portion of said bar setting device opposite said mark.

5. The method of claim 2, being still further characterized in that the spark distributor shaft is released with the starting of the motor associated with the distributor while said head of the setting device is being held against the housing so that the bar of the said setting device is broken at its fragile zone leaving a fragment of the bar within the housing in said opening in said spark advance element which with the outwardly extending head portion of the setting device and the falling outside of the spark distributor housing permits free rotation of said shaft.

6. In the method of claim 1, wherein said advancing wheel element in the distributor is a centrifugally advancing wheel.

7. Process for the temporary setting in a pre-adjusted position and the later quick adjustment of a variable magnetic flux spark distributor designed particularly to cooperate with an internal combustion engine for an automobile vehicle, which distributor includes on the inside of a housing a spark shaft on which is arranged a gear driven by the said shaft and movable in a rotating manner with respect to this shaft under the effect of at least one advance device, the said gear being displaced towards a magnetic flux captor comprising means to channel magnetic flux towards the shaft, the said means being connected to a permanent magnet and corresponding to the nucleus of an induction coil, said process being characterized in that there is provided, on the one hand, in the wall of the housing opposite the advance device which is one with the shaft, a slot whose average line is situate roughly in a level perpendicular to the axle of the shaft of the distributor and, on the other hand, there also being provided in the said zone of the said advance device mounted on said an orifice positioned opposite the said slot; then making the optimum static adjustment of the spark point by positioning the gear with respect to the captor by setting same in predetermined position with respect to the distributor housing while simultaneously holding from without said housing on its external wall surface the head of a bar-like setting device which passes through said slot in the housing and has an intermediate fragile break area disposed within the housing and is internally engaged in said orifice; then finishing the assembly of the distributor in its internal part so as to ready it for use or storage.

8.

A device for the temporary setting in a pre-adjusted position and later quick adjustment of a spark distributor particularly designed to cooperate with an internal combustion engine motor for a vehicle; said distributor including on the inside of a housing an ignition shaft on which is positioned a gear driven by the said shaft and rotatable with respect to the shaft under the effect of at least one advance device, the said gear being displaced toward a magnetic flux captor comprising of means to channel magnetic flux towards the shaft; the said captor being connected to a permanent magnet and constituting the nucleus of an induction coil; said device being characterized in that the housing has, opposite an element of the device which is mounted on said shaft, a slot disposed at least approximately in a plane perpendicular to the axis of the distributor shaft; the said advance device having an opening therein to receive and cooperate with a bar-like setting device having an intermediate fragile break area within said housing with an exterior head portion that is adapted to be held against the external wall of the distributor housing when said bar is passed through said slot in said housing wall.

9. The device of claim 8, wherein said spark distributor is of the variable magnetic flux type.

10. A variable magnetic flux spark distributor assembly adapted for use in conventional internal combustion engines and to be employed in association and combination therewith, said distributor comprising:

i. A housing for said distributor;

ii. A spark shaft within said housing;

iii. Gear means on and driven by said shaft and rotatable with respect to said shaft (ii);

iv. At least one advancing wheel device for movement of the integral internal apparatus and parts in said distributor combination;

v. A magnetic flux captor element in said distributor assembly which channels and conducts magnetic flux towards and to said shaft (ii);

vi. An interior induction coil in connected correspondence with said element (v);

vii. A slot in the wall of said housing (i) generally disposed within the zone of said advancing wheel device (ii) and also simultaneously disposed in a plane that is substantially perpendicular to the axle of said shaft (ii) with said shaft having thereon viii. Said advancing wheel device (iv) which has an orifice made in the area located opposite said slot in said housing (i);

ix. A bar-like setting element with a frangible head portion having an intermediate fragile and breakable sector disposed towards its head;

x. Said setting device being adapted to be passed through said slot (vii) in the housing to engage its inner end in said orifice (viii) with said fragile and breakable sector disposed within said housing (i); and xi. means for holding from without of said housing the extending extremity of said bar-like blocking and setting element so as to thereby and therewith position in optimum co-relative spacing relationship said gear means (iii) and said captor element (v).

11. An assembly according to claim 10, characterized by the fact that the setting element which is adapted to cooperate with the element of the advance device mounted on said shaft is composed of a synthetic material.

12. The assembly of claim 11, wherein said synthetic material is nylon.

13. An assembly according to claim 10 and further characterized by the fact that said setting device is of the screw, bolt and peg type and that it is a threaded bar; and that the opening made in the element of the advance device is a threaded hold whose threading cooperates with the threading of the bar of the setting device.

14. An assembly according to claim 10 and further characterized by the fact that the setting device is adapted to cooperate with the lower plate of the centrifugal advance device which is mounted on said shaft of the spark distributor.

15. An assembly according to claim 14 and further characterized in that the opening which receives and is adapted to cooperate with the bar of the setting device is disposed in a roughly radial position and that the slot through which the bar of the said setting device is adapted to pass is roughly transversal in the side wall of the distributor housing.

16. An assembly according to claim 14 and further characterized in that the opening cooperating with the bar of the setting device is an orifice made in a piece which is integral with the lower plate of said advance device, said piece having a roughly orthogonal shape on the level formed by the said plate and parallel to the lateral wall of the housing.

17. An assembly according to the assembly of claim 10, wherein said advancing wheel device is a centrifugally advancing wheel.

* * * * *